United States Patent [19]

Childers et al.

[11] Patent Number: 4,506,685

[45] Date of Patent: Mar. 26, 1985

[54] HIGH-SPEED COIN SORTING AND COUNTING APPARATUS

[76] Inventors: Roger K. Childers, 13320 SW. Ash, Tigard, Oreg. 97223; Kenneth L. Buchanan, 1540 SW. Clara, Troutdale, Oreg. 97060; Randall Barnette, 1331 NE. 16th Way, Gresham, Oreg. 97030; Delbert L. Buchanan, 18027 SW. Belmore, Lake Oswego, Oreg. 97034

[21] Appl. No.: 369,907

[22] Filed: Apr. 19, 1982

[51] Int. Cl.[3] ..... G07D 3/06

[52] U.S. Cl. ..... 133/3 A; 133/3 H

[58] Field of Search ..... 133/3 A, 3 H; 221/160; 248/97–99, 101, 100; 150/51, 49

[56] References Cited

U.S. PATENT DOCUMENTS

| | | | |
|---|---|---|---|
| 2,348,936 | 5/1944 | Sprenger . | |
| 2,459,970 | 1/1949 | Smith | 248/101 |
| 2,906,276 | 9/1959 | Blanchett et al. . | |
| 2,977,961 | 4/1961 | Buchholz et al. . | |
| 3,065,841 | 11/1962 | Stover | 221/160 X |
| 3,402,848 | 9/1968 | Busey | 248/97 X |
| 3,795,252 | 3/1974 | Black | 133/3 A |
| 3,998,237 | 12/1976 | Kressin et al. . | |
| 4,086,928 | 5/1978 | Ristvedt et al. | 133/3 A |
| 4,098,280 | 7/1978 | Ristvedt et al. . | |
| 4,111,216 | 9/1978 | Brisebarre | 133/3 A |
| 4,234,003 | 11/1980 | Ristvedt et al. . | |

*Primary Examiner*—Stanley H. Tollberg

*Attorney, Agent, or Firm*—Seed and Berry

[57] ABSTRACT

A coin-sorting and counting apparatus in which a mixture of coins of different denominations is deposited on a rotating surface and queued thereon by multiple coin guides. These coin guides define a coin-queueing channel for lining up coins on the rotating surface in an orderly fashion preparatory to introducing them into a coin-sorting channel. To increase the speed of sorting, a coin recirculation channel is also provided for receiving certain ones of the coins which have been moved by the rotating surface past the entrance to the coin-queueing channel and redirecting such coins to such entrance. One of the queueing channel guides also acts as a coin position retainer for retaining those coins which have been moved past the entrance of the queueing channel, without forming into the queue, at the same radial distance from the axis of the rotating surface while the surface moves such coins toward the recirculation channel.

40 Claims, 6 Drawing Figures

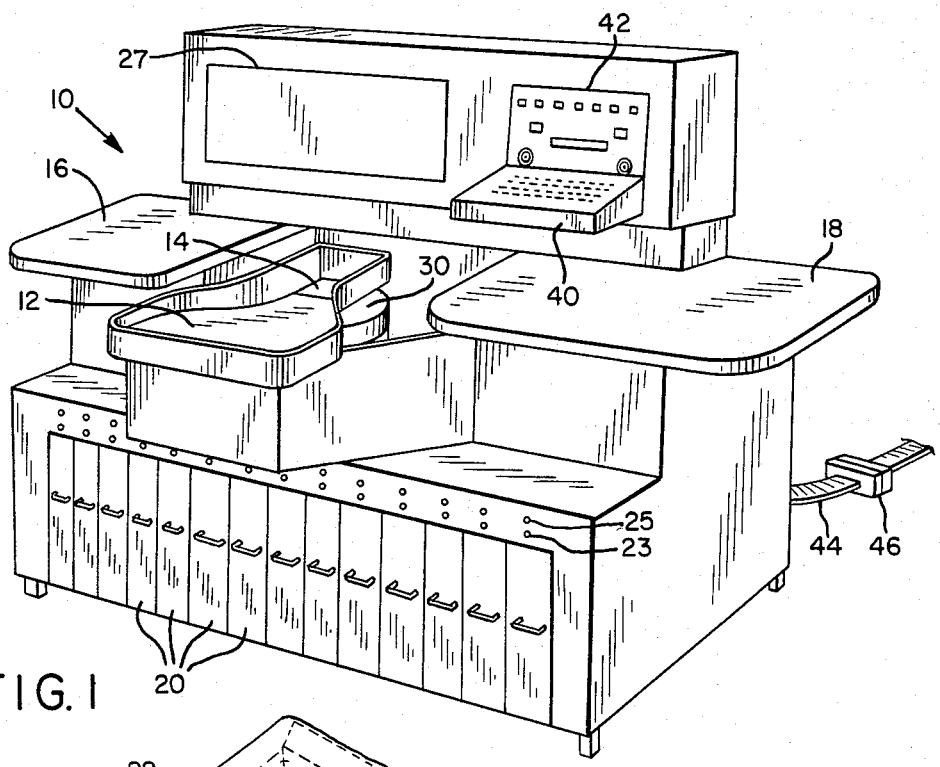
FIG. 1
FIG. 2
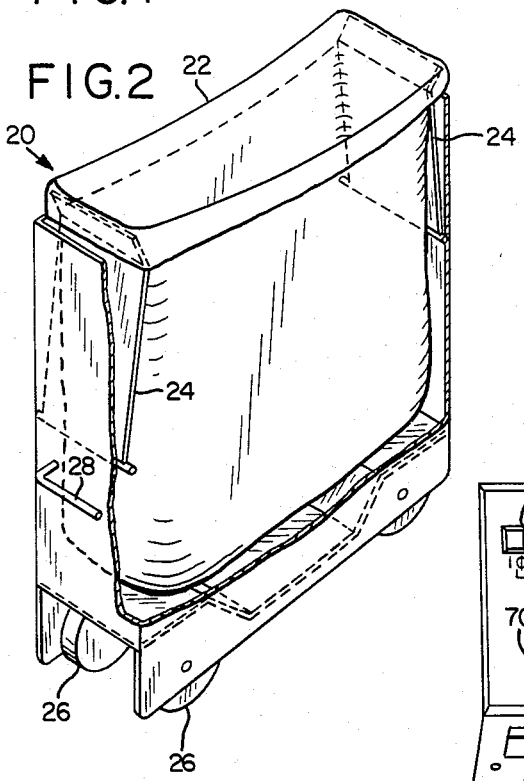
FIG. 4
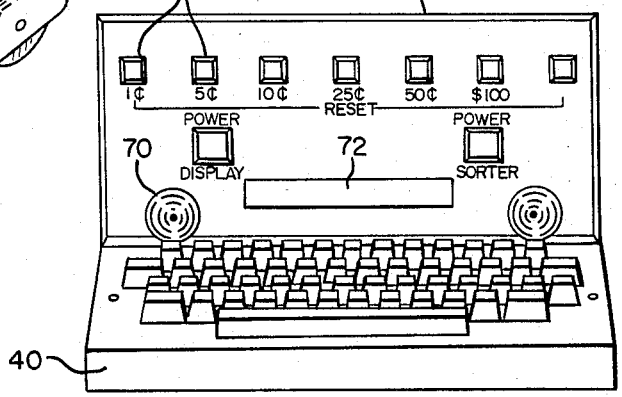

HIGH-SPEED COIN SORTING AND COUNTING APPARATUS

BACKGROUND OF THE INVENTION

This invention relates to improvements in coin-sorting and counting apparatus.

GENERAL DESCRIPTION OF THE PRIOR ART

The large and increasing volume of coin-operated machines makes the rapid and accurate sorting and counting of coins economically necessary. Vending machines, metropolitan area transit systems, pay telephones, and other coin-operated devices have expanded the use of coins and the requirements for economical counting of coins beyond all expectations.

Several machines have been designed for this purpose, exemplified by those disclosed in U.S. Pat. No. 3,795,252 to Black, 4,086,928, to Ristvedt et al., and 4,111,216 to Brisebarre. Each has coin sorting by centrifugal force according to denomination, counting of the individual denominations by some type of sensing, and storing and display of the information about the counts during the process. Each also provides for storing and removal of the coins during counting.

The Black patent sorts coins by having them captured in tapered radial slots where, under the influence of centrifugal force, they move outward until they reach the point at which the slot has the dimensions of the coin diameter, at which point they are ejected into collecting chutes, where they are counted and directed into coin bags or other receptacles. Sorting and counting speeds of 4,000 coins per minute are claimed at a rotational speed of 1,500 rpm.

The Ristvedt et al. patent discloses a machine to sort coins by subjecting them to a "queueing" head which directs the mixture of coins into a "queue" from which they are sorted denominationally and counted and bagged by a process similar to that disclosed by Black. Any improvement in performance to Ristvedt et al. over Black may be due primarily to the design of the queueing head which forms the coins into a queue before sorting and counting. Although speeds of 7,500 to 8,000 coins per minute are claimed in the patent, in actual practice these claims are somewhat optimistic, relating primarily to single-coin batches. With multiple coin batches, the best that can be obtained consistently is about 4,500 coins per minute with a four-coin mix.

The Brisebarre patent discloses a machine similar to that of Ristvedt et al. and, although the operating speed is not specified, it will give, in actual operation, about the same performance with the same coin mix.

Several problems have been encountered with previous machines, including those described above. The problem of fastening empty coin bags to the machine and removing them when full has presented limitations on the number of coins that can be processed in a given time since it limits the number of machines that can be handled by one attendant. Previous techniques include tying the bags to the chutes, clamping them in place, etc. Even though provisions are made to switch the flow of coins from a full bag to an empty one, the longer it takes to insert and remove the bags, the fewer machines can be taken care of in a given time.

Another problem relates to the ease of changing programs. Those machines which have changeable programs are "hard-wired" so that programs can be changed with difficulty, if at all. Present machines typically give printouts that indicate date of transaction, batch or transaction number, account number, machine number, number of coins and value for each denomination processed, coin sub-total, currency sub-total and batch total. Some choice of format of the printout is available. Such machines offer a small keyboard which permits the operator to choose from among the available types of formats, programs, etc. Displays are available which not only give the above information in readout form, but which prompt the operator in setting up a particular program. However, changing the programs beyond those offered is not possible.

SUMMARY OF THE PRESENT INVENTION

The present invention is designed to alleviate the above-mentioned problems and increase the speed of sorting, reduce the amount of time necessary to mount and unmount the coin-bags, and increase the versatility of the apparatus in its data display, collection, retention, and in its programmability.

As coins are poured into the coin-receiving hopper of the machine they are funneled onto a rotating surface which is covered with a resilient, frictional pad. The rotation causes the coins to be subject to centrifugal force which directs them radially toward the outer edge of the rotating surface where they encounter a first peripheral barrier. The rotating surface itself has its outer edge elevated at an angle of about 4° with respect to the center, as disclosed in U.S. Pat. No. 4,086,928, and the center has formed therein a raised portion to prevent one or more coins from becoming centered thereat and being thereby prevented from being moved outwardly by the centrifugal force.

The rotating surface has spaced a short distance above it an improved queueing head means which has incorporated onto its surface multiple guide means defining a number of channels and areas thereon: a queueing channel, a recirculation channel, a sorting channel and an exit area. One of the guide means also acts as a position retainer which has the function of retaining coins in their radial position until they can be injected into the recirculation channel. The queueing head means is spaced above the rotating surface slightly less than the thickness of a new half-dollar, but more than the thickness of a badly worn half-dollar. This spacing permits all single coins to enter the space between the rotating surface and the queueing head freely under the influence of centrifugal force, but it also permits some coins stacked face-to-face to enter, requiring special measures to remove the top coins, as described below. (Such stacking will hereinafter be referred to as "face stacking.") In addition to the face-to-face stacking, coins will also "stack" edge-to-edge under the influence of centrifugal force and will lock into position if they have milled edges (with which all U.S. coins except the penny and nickel are fabricated). Because the milled edges interlock, it is easy for three coins to become locked in a triangular relationship and some way must be provided to break up such formations. (Such formation will hereinafter be referred to as "edge stacking.")

The multiple guide means are shaped and arranged on the surface of the queueing head in such a way as to channel the mix of coins into a queue to be sorted. However, stacked coins are not sorted but are returned either to the central loading area or into the recirculation channel.

The queueing channel is defined by a peripheral barrier, a first guide means and a second guide means. Said first guide means has multiple functions which will be explained in greater detail below:

forcing the outermost group of coins into a queue;

forcing the innermost group of coins back into the loading area;

forcing some coins, intermediate in location between the outermost and innermost coins above, underneath the guide to be held in fixed radial position until they exit into the recirculation channel; and performing a first separation of some face stacked coins.

The first guide means is separated from the peripheral barrier by a distance which is slightly more than the diameter of the largest coin to be processed, but slightly less than $\sqrt{3}$ times the diameter of the smallest coin to be processed. The reason for this latter distance is that such milled coins can become locked together in an equilateral triangular arrangement and could block the queueing channel, causing a jam. A channel width slightly less than this amount will cause the innermost coin to be captured underneath the guide and be carried around into the recirculation channel.

The entry tip of the second guide means is encountered by the queue approximately halfway along the length of the first guide means, but on the opposite side of the queueing channel. The peripheral barrier ends here and the second guide means starts. It permits the coins, under the influence of centrifugal force, to move outward in a controlled manner until they encounter a second peripheral barrier spaced about the width of the queueing channel outward from the radial distance of where the first peripheral barrier would be. At this point, the queue enters the exit area, defined by the exit tip of the second guide means, the first exit tip of the first guide means, the second peripheral barrier and the entry and exit tips of the third guide barrier. The entry tip of the third guide barrier is shaped to match the position and location of the cross-sectional shape of the second peripheral barrier, but as the shape of the third guide means slants across the path of the queue, the spacing of the barrier above the surface of the rotating surface decreases rapidly permitting single coins to squeeze under the exit barrier but forcing face-stacked coins to be swept around out of the exit area into the recirculation channel and back to the queueing channel. This is the second and final separation of stacked coins in the separation process.

Those coins which exit into the sorting channel encounter sorters as described by U.S. Pat. Nos. 4,086,928 and 4,111,216 and are thrown off of the rotating surface, counted by means such as disclosed in U.S. Pat. Nos. 3,795,252, 4,086,928 and 4,111,216, and channeled to the coin bags. Those coins not exited are recirculated and end up being queued with the rest of the coins.

As stated earlier above, some coins will encounter edge stacking, and the combinations will range in size from three half-dollars to three dimes, as well as various combinations in between. Each of these combinations needs to be broken up permitting only a single line, or queue, of coins to be presented to the exit guide means. It is the function of the first guide means to effect this separation. Those coins whose centers do not fall outside of the center line of the entry tip of the first guide barrier will be captured by said first guide means and will pass underneath, retaining their radial distance from the center until they exit from beneath the guide means into the recirculation area. All other coins will be deflected back into the loading area to go through the process once again.

Those coins which have been counted are channeled into chutes which carry them into the coin bags. Because it is costly in time to shut down the machine each time that a cain bag becomes full or has reached the count desired, devices to deflect the stream of coins from a full coin bag into an empty one have been developed. Such deflectors are shown in the aforementioned patents and will not be dealt with further here.

However, even when alternate coin bags are provided, the time required to detach the bag, place it in storage and attach another bag in its place can be time-consuming. Such attachments have heretofore been by tying or by some kind of clamp. Even clamps require maneuvering of the clamp and the bag, and severely limit the number of machines one attendant can oversee since each machine may have up to 12 bags (and more for sorters of foreign coins).

The present invention provides a quick and easy way to change coin bags. It provides a container which can be used as a bulk container, in addition to holding a coin bag upright and open to receive coins, while permitting the coin bag to be removed quickly and replaced with little time and effort expended. In practice, the bag is simply inserted into the container, one side of the mouth of the bag is placed over a bracket means which will hold that portion of the mouth in an open condition, and the opposite side of the mouth of the bag is then placed over another, preferably spring-loaded, bracket of similar design which holds the bag open to receive coins. The operation is extremely simple and quick in execution. If desired, several bags can be mounted on their containers ahead of time so that full bags can be replaced merely by withdrawing the full container and inserting an empty one. The containers are provided with wheels so that insertion and withdrawal are easy. The display board of the terminal (described below) has a visual indication (as well as an audible alarm) that a container is full, and the containers have visible indicator means associated with them to indicate which container needs to be changed. The containers have handles to facilitate withdrawal and insertion.

In order to overcome this problem of obtaining more flexible programming of such machines, the apparatus of the invention incorporates a computer terminal by means of which the existing operating programming of the machine can be modified or erased and rewritten. The program is written on an erasable, programmable, read-only memory (EPROM), and thus can be modified as desired directly from the machine. This gives an enormous advantage when dealing with many different types of coin-sorting and counting situations.

BRIEF DESCRIPTION OF THE DRAWINGS

FIG. 1 shows a general view of a high-speed coin sorter and counter as embodied in the present invention.

FIG. 2 shows a general view of the coin bag receiving receptacle of the invention.

FIG. 4 shows a closeup view of the control panel of the invention, revealing the display panel and the keyboard.

DETAILED DESCRIPTION OF THE INVENTION

Figure 3:
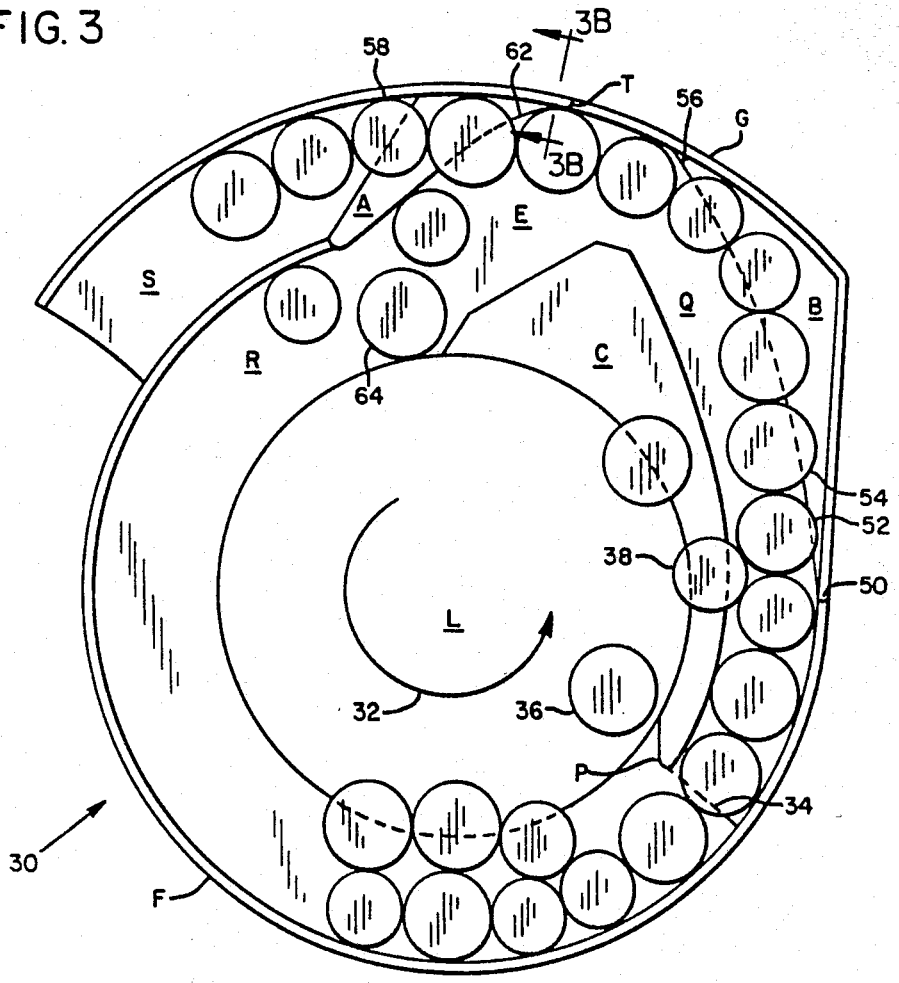
FIG. 3 shows a general view of the queueing head of the invention, with its queue forming guides and separators.

Turning now to FIG. 1, a general view of the apparatus 10 which includes the improvements which are the subject matter of the invention is shown. An undifferentiated mix of coins is poured into the loading tray 12 and is moved into the hopper 14 located immediately above the queueing head 30, described below more completely. In this area they are separated, sorted, counted and distributed into coin bags which are mounted in the coin-bag holding receptacles 20, of which there are at least two for each denomination. When a coin bag is full or has the desired number of coins in it, the flow of coins is switched into an adjacent coin bag, an alarm sounds, an indicator 23 lights up, the receptacle 20 containing the full bag is withdrawn, and a new receptacle 20 containing an empty bag is inserted into the vacant space. The visual indicators 23 and 25 show the state of the individual coin bags held by the receptacles immediately below them, and the display panel 27 also has visual indicators which show that a coin bag needs attention.

The display panel 27 shows the number of coins of each denomination which has been counted in a particular batch; the value of the counted coins; the subtotal for a particular bag of a batch, and the total for the batch. In addition, a character printer prints out the information concerning a particular bag, batch or run as desired. It reaches into the microprocessor memory to match up the information of present batches to that of other batches for a particular customer, and helps to protect all parties involved in a particular transaction from error or fraud.

A display panel 42 is associated with a computer terminal keyboard 40, which is used to program a specific sorting and counting program desired for a particular batch of coins. The keyboard 40, in addition to being connected to an internal microprocessor (not shown), may also be connected via bus 44 and connector 46 to an external computer. The external connectors are RS232C compatible. Counters 16 and 18 provide work space.

Turning now to FIG. 2, we see a cutaway view of one of the coin-bag holding receptacles 20. The coin bag 22 is held in fixed, open position as shown by brackets 24. One or the other or both of brackets 24 can be hinged and retractably spring-loaded to keep the mouth of the bag open and in some tension by any of several well-known means. If one of the brackets 24 is not so hinged, it can be fastened rigidly to the end of the receptacle 20. The receptacle 20 can be mounted on wheels 26, to facilitate ease of withdrawal and insertion. It can also have a handle 28 for the same purposes.

To operate, the portion of the coin bag 22, which is folded over the retractable bracket 24, is pressed inward and lifted off the bracket. The other side of the bag 22 then can be lifted from its bracket easily, the bag can be lifted our and further dealth with. A new bag 22 is then inserted in the receptacle 20, one side folded over one of the brackets 24, and the other bracket 24 depressed far enough so that the bag can be folded over as before. It can be seen that the operation is simple and rapid. No clamps or ties have to be manipulated, and the whole operation can be conducted at a convenient location.

Figure 3A:
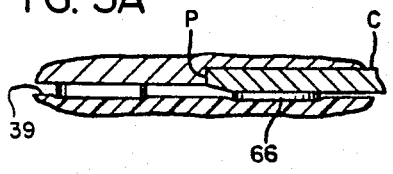
FIG. 3A is a cross-sectional view of coins in the space between the rotating surface and the queueing head.

Turning now to FIG. 3, we see the bottom face of the queueing head 30. It is to be remembered in the description which follows that the viewer is facing up and that the rotating surface (not shown) is spaced toward the viewer slightly less than the thickness of a new half-dollar. As the coins come through the loading opening L, they encounter the centrifugal force generated by the rotating surface which is covered with a resilient frictional pad, rotating in the direction shown by the arrow. Consequently, they tend to move in a spiral direction from the center of the loading area L underneath the surface of the queueing head 30 into the recirculation area R, which extends around the entry point of the guide C. They are free to do this except in the area occupied by the guide C. As the coins move around and outward they encounter the first peripheral barrier F which prevents them from flying off the rotating surface. A line, or queue, of coins starts to form against the first peripheral barrier F, with other coins edge-stacked against them inwardly of the queue. When the queue reaches the dotted line 34, which marks the entrance to the queueing channel Q, the coins edge-stacked against them encounter the entry tip P of the guide C and either are thrown back into the loading area L, as illustrated by coin 36, or pass under the tapered tip P of the guide C, as illustrated by coin 38, and are held in their radial position by the pressure of the guide C against the coin 66 on top and the pressure of the resilient pad 39 underneath, as shown in FIG. 3A, until they pass into the recirculation channel R, as illustrated by coin 64.

Figure 3B:
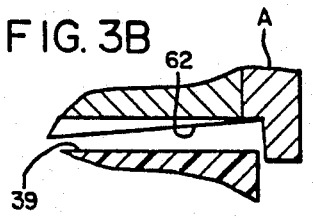
FIG. 3B is a cross-sectional view of FIG. 3 along the lines 3B.

As the queue encounters entry tip 50 of guide B, they are not longer restrained by first peripheral barrier F and start to slide outward by centrifugal force, as illustrated by coins 52 and 54 and succeeding coins, as guide B is tapered downwardly in an outward direction from the level of the queueing channel Q to the level of the rotating surface at the outer edge. Eventually, as the coins are urged forward by the rotation of the rotating surface, they encounter second peripheral barrier G near the exit tip 56 of guide B. They then are guided along until they encounter the entry tip T of exit guide A. Exit guide A is shaped at that point to match the shape of second peripheral barrier G, as shown in cross-sectional shape in FIG. 3B. The curve of the entry tip T of guide A is substantially greater than the diameter of the largest coin to be processed so that the edge of the coin is captured under the entry tip T of guide A. Because of the combined pressure of the rotating surface and the centrifugal force, the coin is pressed downward into the resilient, frictional surface 39 and passes under guide A into sorter channel S and passes on to the sorters (not shown) which separate them denominationally after which they are counted.

However, it sometimes happens that two coins which are face-stacked arrive at entry tip T of guide A. To prevent both coins being passed under guide A into sorting channel S, the edge 62 of guide A is rapidly (with respect to the movement of a coin) moved down into the space between the surface of queueing head 30 toward the level of the rotating surface, thus capturing the stacked coin 60 and moving it out of the exit area E and into the recirculation channel R.

Turning now to FIG. 4, we see a depiction of the display panel 42 and the terminal keyboard 40 of the invention. The addition of this feature permits modifying of the sorting and counting programs directly from the machine. Present machines require that new microprocessor chips be inserted in place of the old in order to change programs. However, with this feature, it is possible to change programs right from the machine with the modifying of the EPROM chip being done in the machine itself. The advantages for permitting future modes of operation not yet conceived can be seen.

The display panel 42 associated with the keyboard 40 includes visual indicators 68 of the state of the coin bags and audible alarms 70 for calling an attendant when coin bags are full. It also includes an alpha-numeric display 72 which permits the programmer to enter information into the system and receive response to queries.

It will be obvious to those skilled in the art that many changes and modifications in the invention described herein could be made without departing from the spirit or intent of the invention. Accordingly, it is determined that the scope of the invention and the protection afforded by this patent are to be determined solely by the claims herein.

What is claimed is:

1. A coin sorting and counting apparatus having a coin receiver for collecting coins after they have been sorted and counted, said receiver comprising a container with opposed end walls for holding a coin bag therein, said container having a pair of flaps for removably holding said coin bag in an open position, said flaps being pivotally mounted in opposed relationship, with one flap being mounted on each of the opposed end walls of said container and selectively and independently pivotable with respect to said container through a plane substantially perpendicular to said end walls between a first position, for holding a coin bag in an open position, and a second position, for permitting removal and replacement of a coin bag in said container, and a biasing means for biasing said flaps toward said first position.

2. The apparatus of claim 1 wherein said container is positionable beneath the coin sorting and counting apparatus and has floor-engaging wheels for easy movement of said containers from beneath said apparatus for removal and replacement of coin bags from said container.

3. The apparatus of claim 1 wherein said biasing means is a spring resiliently retaining said flap in said first position.

4. The apparatus of claim 1 wherein said container is a laterally walled, open-ended receptacle sized for receiving said bag therein, and each of said flaps is an elongated member pivotally mounted by one end portion to a midportion of an inside wall surface of said container end wall and extending upwardly therefrom, and having an opposite free end portion for supportably engaging said bag, said elongated member being positioned substantially adjacent to said inside wall surface when in said first position and biased for rotation toward said first position by said biasing means coacting between said elongated member and said container.

5. The apparatus of claim 1 wherein said biasing means provides sufficient biasing force on said flap to maintain the mouth of said bag under tension in said open position.

6. The apparatus of claim 2 wherein the coin sorting and counting apparatus has at least two of said containers for each denomination of coin being sorted, said containers for all denominations being positionable in side-by-side alignment beneath the apparatus and independently forwardly movable from beneath the apparatus.

7. The apparatus of claim 4 wherein said free end portion of said elongated member extends upwardly to a position above an open end of said container.

8. The apparatus of claim 7 wherein said free end portion extending above said open end has a bag-engaging portion angled laterally outward.

9. A coin-queueing head positionable in a spaced relationship over a rotating flexible surface for processing randomly oriented coins and placing them in a single layer, single file, comprising:

a central opening in said head for receiving said randomly oriented coins;

a first peripheral limit circumferentially extending partially about said central opening and positioned radially distant from said central opening to define a coin circulation area and limit outward radial travel of said coins;

an elongated guide circumferentially extending partially about and positioned adjacent to said central opening and radially inward of said first peripheral limit, said guide having at least a first portion thereof circumferentially coextensive with a portion of said first peripheral limit and spaced apart therefrom by slightly greater than the diameter of the largest diameter coin of said coins to define an elongated coin-queueing channel therebetween substantially unobstructed along its length for unimpeded passage of coins therethrough received from said circulation area and formation of a single file queue therein against said first peripheral limit, said first portion of said guide projecting to a distance above said surface sufficient to depress into said flexible surface any of said coins engaged thereby for travel thereunder to substantially maintain the radial position of said coins as said surface rotates, said first portion of said guide being positioned to deliver said coins captured thereunder directly back into said circulation area substantially in radial position for entry into said coin-queueing channel;

a second peripheral limit circumferentially extending partially about said central opening and positioned radially outward of said first peripheral limit to define a coin-processing area between a second portion of said guide and said second peripheral limit and limit outward radial travel of said coins received from said coin-queueing channel; and an arcuate engagement wall extending generally transverse to the travel of said coins beyond said coin-processing area, said wall extending substantially from said second peripheral limit to said first peripheral limit, and projecting to a distance above said surface along a portion of said wall adjacent to said second peripheral limit sufficient to engage and block passage of one of a pair of face-stacked coins while passing coins resting directly on said surface thereunder, said wall being spaced apart from said guide to define a recirculation passageway therebetween and angularly oriented to divert said blocked coins along said wall in a smooth arcuate path through said recirculation passageway and back into said circulation area, whereby when said head is operated with said surface rotating, said coins pass under said engagement wall in a single layer and a single file ready for sorting by denomination.

10. The coin-queueing head of claim 9, further including a third peripheral limit extending partially about said central opening and positioned radially outward of said first peripheral limit, to define a coin sorting channel between a portion of said first peripheral limit circumferentially coextensive with said third peripheral limit.

11. The coin-queueing head of claim 9 wherein said engagement wall has a continuous arcuate face downwardly inclined in a generally inward direction to a level substantially adjacent to said surface at said first peripheral limit, said incline being sufficient to block and divert into said recirculation passageway coins spaced radially inward from said second peripheral limit and only permit passage under said engagement wall of coins in a single file adjacent to said second peripheral limit.

12. The coin-queueing head of claim 9 wherein said engagement wall slopes downwardly toward said surface in a generally inward direction and is angled generally inward to separate face-stacked coins and guide an upper one of said face-stacked coins gradually inward through said recirculation passageway.

13. The coin-queueing head of claim 9 wherein said engagement wall is angled generally inward for guiding coins blocked thereby gradually inward through said recirculation passageway to said circulation area as said blocked coins are carried along by said rotating surface.

14. The coin-queueing head of claim 13 wherein said engagement wall has a radius of curvature greater than the radius of the largest diameter coin of said coins.

15. The coin-queueing head of claim 14 wherein said radius of curvature of said engagement wall gradually increases inwardly from its value adjacent to said second peripheral limit.

16. The coin-queueing head of claim 9, further having a laterally enlarged coin-receiving area through which said coins pass as they travel from said first peripheral limit to said second peripheral limit, whereby increased inter-coin spacing is possible during the transition to facilitate formation of a queue and elimination of edgewise and face stacking of coins.

17. The coin-queueing head of claim 9 wherein said guide second portion has a wall portion spaced radially inward from said peripheral limit and extending generally transverse to the travel of said coins beyond said coin-queueing channel, said wall portion projecting to a distance above said surface to engage and block passage of an upper one of a pair of face-stacked coins spaced radially inward from said second peripheral limit while passing coins resting directly on said surface thereunder, said wall portion being angled generally outward to divert said blocked coin of said pair of face-stacked coins toward said second peripheral limit, whereby face-stacked coins positioned inward of the queue forming at said second peripheral limit are separated by said wall portion of said guide second portion.

18. The coin-queueing head of claim 17 wherein said wall portion of said guide second portion is positioned radially outward of said guide first portion.

19. The coin-queueing head of claim 9 wherein said guide first portion is positioned radially inward of said engagement wall to deliver said coins captured under said guide first portion back into said circulation area unimpeded by said engagement wall, whereby said coins so delivered do not impact said engagement wall and disturb any queue theretofore achieved.

20. A coin-queueing head positionable in a spaced relationship over a rotating flexible surface for processing randomly oriented coins and placing them in a single layer, single file, comprising:

a central opening in said head for receiving said randomly oriented coins;

a first peripheral limit circumferentially extending partially about said central opening and positioned radially distant from said central opening to define a coin circulation area and limite outward radial travel of said coins:

a guide circumferentially extending partially about and positioned adjacent to said central opening, said guide being positioned radially inward of said first peripheral limit by a distance at least as great as the diameter of the largest diameter coin of said coins, said guide having at least a portion thereof circumferentially coextensive with a portion of said first peripheral limit to define an elongated, laterally restricted coin-queueing channel therebetween substantially unobstructed along its length for unimpeded passage of coins therethrough received from said circulation area, said guide projecting to a distance above said surface sufficient to depress any of said coins positioned radially inward of said first peripheral limit sufficient to travel thereunder into said flexible surface to substantially maintain the radial position thereof as said surface rotates for their delivery back into said circulation area;

a second peripheral limit circumferentially extending partially about said central opening and positioned radially outward of said first peripheral limit, to limit outward radial travel of said coins received from said coin-queueing channel; and an engagement member positioned and extending generally transverse to the travel of said coins passing through said coin-queueing channel, said member extending substantially from said second peripheral limit to said first peripheral limit, and projecting to a distance above said surface sufficient to engage and block passage of one of a pair of face-stacked coins, said member being spaced apart from said guide to define a recirculation passageway therebetween and angularly oriented to divert said blocked coins through said recirculation passageway and back into said circulation area.

21. The coin-queueing head of claim 20, further including a third peripheral limit extending partially about said central opening and positioned radially outward of said first peripheral limit, to define a coin-sorting channel between a portion of said first peripheral limit circumferentially coextensive with said third peripheral limit.

22. The coin-queueing head of claim 20 wherein said engagement member has a continuous arcuate face downwardly inclined in a generally inward direction to a level substantially adjacent to said surface at said first peripheral limit, said incline being sufficient to block and divert into said recirculation passageway coins spaced radially inward from said second peripheral limit and only permit passage under said engagement member of coins in a single file adjacent to said second peripheral limit.

23. The coin-queueing head of claim 20 wherein said engagement member has a continuous arcuate face sloping downwardly toward said surface in a generally inward direction and angled generally inward to separate face-stacked coins and guide an upper one of said face-stacked coins gradually inward through said recirculation passageway.

24. The coin-queueing head of claim 20 wherein said engagement member has an arcuate face angled generally inward for guiding coins blocked thereby gradually inward through said recirculation passageway to said circulation area as said blocked coins are carried along by said rotating surface.

25. The coin-queueing head of claim 24 wherein said engagement member face has a radius of curvature greater than the radius of the largest diameter coin of said coins.

26. The coin-queueing head of claim 25 wherein said radius of curvature of said engagement member face gradually increases inwardly from its value adjacent to said second peripheral limit.

27. The coin-queueing head of claim 20, further having a laterally enlarged coin-receiving area through which said coins pass as they travel from said first peripheral limit to said second peripheral limit, whereby increased inter-coin spacing is possible during the transition to facilitate formation of a queue and elimination of edgewise and face stacking of coins.

28. The coin-queueing head of claim 20 wherein said guide has a second portion spaced radially inward from said peripheral limit and extending generally transverse to the travel of said coins beyond said coin-queueing channel, said second portion projecting to a distance above said surface to engage and block passage of an upper one of a pair of face-stacked coins spaced radially inward from said second peripheral limit while passing coins resting directly on said surface thereunder, said second portion being angled generally outward to divert said blocked coin of said pair of face-stacked coins toward said second peripheral limit, whereby face-stacked coins positioned inward of the queue forming at said second peripheral limit are separated by said second portion.

29. The coin-queueing head of claim 28 wherein said second portion of said guide is positioned radially outward of said guide portion coextensive with said first peripheral limit.

30. The coin-queueing head of claim 20 wherein said guide portion coextensive with said first peripheral limit is positioned radially inward of said engagement member to deliver said coins captured under said guide portion back into said circulation area unimpeded by said engagement member.

31. A coin-queueing head positionable in a spaced relationship over a rotating flexible surface for processing randomly oriented coins and placing them in a single layer, single file, comprising:

a central opening in said head for receiving said randomly oriented coins;

a peripheral limit circumferentially extending partially about said central opening and positioned radially distant from said central opening, said peripheral limit limiting outward radial travel of said coins and defining a coin circulation area between said central opening and a portion of said peripheral limit;

a guide circumferentially extending partially about said central opening and positioned radially inwad of said peripheral limit by a distance at least as large as the diameter of the largest diameter coin of said coins, said guide having at least a portion thereof circumferentially coextensive with a portion of said peripheral limit to define a laterally restricted coin-queueing channel therebetween with a substantially unobstructed opening for receiving coins from said circulation area, said guide projecting to a distance above said surface sufficient to depress any of said coins traveling thereunder into said flexible surface to substantially maintain the radial position thereof as said surface rotates for delivery back into said circulation area; and an engagement wall positioned to encounter said coins passing through said coin-queueing channel, said wall extending generally transverse to the travel of said coins and having a portion projecting to a distance above said surface sufficient to trap and pass coins positioned adjacent to said peripheral limit in a single layer thereunder and a portion radially inward therefrom projecting to a distance above said surface sufficient to engage and block passage of said coins positioned a selected distance inward of said peripheral wall, said wall being spaced apart from said guide to define a recirculation passageway therebetween communicating with said circulation area and positioned to divert said blocked coins back into said circulation area.

32. The coin-queueing head of claim 31 wherein said guide has a second portion spaced radially inward from said peripheral limit and extending generally transverse to the travel of said coins beyond said coin-queueing channel, said second portion projecting to a distance above said surface to engage and block passage of an upper one of a pair of face-stacked coins spaced radially inward from said second peripheral limit while passing coins resting directly on said surface thereunder, said second portion being angled generally outward to divert said blocked coin of said pair of face-stacked coins toward said second peripheral limit, whereby face-stacked coins positioned inward of the queue forming at said second peripheral limit are separated by said second portion.

33. The coin-queueing head of claim 32 wherein said second portion of said guide is positioned radially outward of said guide first portion coextensive with said peripheral limit.

34. The coin-queueing head of claim 31 wherein said guide portion coextensive with said peripheral limit is positioned radially inward of said engagement wall to deliver said coins captured under said guide portion back into said circulation area unimpeded by said engagement wall.

35. The coin-queueing head of claim 31, further having a laterally enlarged coin-receiving area through which said coins pass as they travel beyond said first peripheral limit to said toward said engagement wall.

36. The coin-queueing head of claim 31 wherein said engagement wall has a continuous arcuate face downwardly inclined in a generally inward direction.

37. The coin-queueing head of claim 36 wherein said engagement wall slopes downwardly toward said surface in a generally inward direction.

38. The coin-queueing head of claim 37 wherein said engagement wall is angled generally inward for guiding coins blocked thereby gradually inward through said recirculation passageway to said circulation area as said blocked coins are carried along by said rotating surface.

39. The coin-queueing head of claim 38 wherein said engagement wall has a radius of curvature greater than the radius of the largest diameter coin of said coins.

40. The coin-queueing head of claim 39 wherein said radius of curvature of said engagement wall gradually increases in an inwardly direction.

* * * * *